US010093884B2

(12) United States Patent
Falk et al.

(10) Patent No.: US 10,093,884 B2
(45) Date of Patent: Oct. 9, 2018

(54) PEROXIDE-FREE POLYMER AND SURFACTANT LIQUID LAUNDRY ADDITIVE COMPOSITIONS

(71) Applicant: THE CLOROX COMPANY, Oakland, CA (US)

(72) Inventors: Nancy A. Falk, Pleasanton, CA (US); Michael D. Capracotta, Wyandotte, MI (US); Stephen F. Gross, Wyandotte, MI (US); Ashley M. McDaniel, Pleasanton, CA (US); Aminah M. Rumjahn, San Francisco, CA (US); Kevin M. Salmon, Wyandotte, MI (US)

(73) Assignee: The Clorox Company, Oakland, CA (US)

( * ) Notice: Subject to any disclaimer, the term of this patent is extended or adjusted under 35 U.S.C. 154(b) by 89 days.

(21) Appl. No.: 15/294,344

(22) Filed: Oct. 14, 2016

(65) Prior Publication Data

US 2018/0105768 A1 Apr. 19, 2018

(51) Int. Cl.

| | |
|---|---|
| ***C11D 1/72*** | (2006.01) |
| ***C11D 3/22*** | (2006.01) |
| ***C11D 3/37*** | (2006.01) |
| ***C11D 3/00*** | (2006.01) |
| ***C11D 3/42*** | (2006.01) |
| ***C11D 1/66*** | (2006.01) |
| ***C11D 1/14*** | (2006.01) |
| ***C11D 11/00*** | (2006.01) |

(52) U.S. Cl.

CPC ..... *C11D 3/0036* (2013.01); *C11D 1/146* (2013.01); *C11D 1/66* (2013.01); *C11D 3/0047* (2013.01); *C11D 3/222* (2013.01); *C11D 3/225* (2013.01); *C11D 3/3723* (2013.01); *C11D 3/3757* (2013.01); *C11D 3/42* (2013.01); *C11D 11/0017* (2013.01)

(58) Field of Classification Search

CPC .... C11D 1/72; C11D 3/22; C11D 3/37; C11D 3/3723

See application file for complete search history.

(56) References Cited

U.S. PATENT DOCUMENTS

| | | | | |
|---|---|---|---|---|
| 4,347,149 | A | 8/1982 | Smith et al. | |
| 5,904,735 | A | 5/1999 | Gutierrez et al. | |
| 9,034,813 | B2 | 5/2015 | Man et al. | |
| 2004/0063597 | A1 | 4/2004 | Adair et al. | |
| 2013/0150278 | A1 | 6/2013 | Magennis et al. | |
| 2013/0247936 | A1* | 9/2013 | Davister ..... | C11D 1/008 134/6 |

FOREIGN PATENT DOCUMENTS

| | | | |
|---|---|---|---|
| EP | 0794245 | B1 | 9/1997 |
| EP | 0839903 | B1 | 5/1998 |
| WO | 2015172284 | A1 | 11/2015 |

* cited by examiner

*Primary Examiner* — Brian P Mruk

(74) *Attorney, Agent, or Firm* — Alok Goel

(57) ABSTRACT

Treatment compositions for use in laundry capable of effectively removing stains better than detergent alone, and which can be used both through the wash and as a pre-treatment. As a pre-treatment, the compositions remove stains "right before your eyes". The compositions may be free of oxidizing agents so as to be safe for use on a wide variety of fabrics and dyes. The composition may include one or more alkoxylate surfactants and a polymeric anti-redeposition agent selected from the group consisting of an ethoxylated polyethyleneimine polymer, and an acrylate copolymer. The composition may be free of enzymes, ether sulfate surfactants, and alkylene oxide ("EO" and "PO") sulfate surfactants.

20 Claims, No Drawings

PEROXIDE-FREE POLYMER AND SURFACTANT LIQUID LAUNDRY ADDITIVE COMPOSITIONS

BACKGROUND OF THE INVENTION

1. The Field of the Invention

The present invention is generally related to compositions for use in laundering clothing and other fabrics, particularly compositions for use in improving stain removal through pretreatment and/or during washing.

2. Description of Related Art

Various stain removal treatments are available for laundry use applications. Many such treatment compositions are added to the wash water used to wash such fabrics, or are used in pre-treating such fabrics prior to washing within the wash water. While numerous treatment compositions are available, there exists a continuing need for pre-treatment and other compositions providing improved efficacy in stain removal. It would be a further benefit if such a composition could both (1) improve performance when used through the wash (i.e., added to the wash water during washing) and (2) provide excellent performance when used as a pre-treatment to remove stains from fabrics.

The present disclosure provides stain treatment compositions exhibiting such improved efficacy. In particular, in at least some embodiments, the disclosed compositions both boost performance through the wash and effectively pre-treat stains for immediate removal (i.e., when used as a pre-treatment, the compositions can remove stains from fabrics immediately, "right before your eyes").

BRIEF SUMMARY OF THE INVENTION

The present invention is directed to treatment compositions useful as a pre-treatment to a washing step (e.g., as a laundry pre-treatment), useful in boosting stain removal during washing (e.g., when added to the wash water), or both. In an embodiment, the treatment composition includes an alkoxylate surfactant, and a polymeric anti-redeposition agent selected from the group consisting of an ethoxylated polyethyleneimine polymer, an acrylate copolymer, and combinations thereof. The composition typically includes water, and may be free of one or more of oxidizing agents (e.g., hypohalites, peroxides, or other oxidizing or bleaching agents), enzymes, ether sulfate surfactants, ethylene oxide sulfate surfactants, and propylene oxide sulfate surfactants.

Another embodiment may be directed to a treatment composition consisting essentially of, or consisting of an alkoxylate surfactant (e.g., included in an amount up to about 10% by weight of the composition), and a polymeric anti-redeposition agent selected from the group consisting of an ethoxylated polyethyleneimine polymer, an acrylate copolymer, and combinations thereof. The composition typically includes water, and may optionally include one or more of a thickener, an optical brightening agent, a co-surfactant, a hydrotrope, a fragrance, a dye, a pigment, a pH adjusting agent, a stain and soil repellant, a lubricant, a solubilizing agent, a suspension agent, a stabilizer, a defoamer, a preservative, a lubricant, a complexing agent, a chelating agent, and combinations thereof. The composition may be free of one or more of the following: oxidizing agents (e.g., hypohalites, peroxides, or other oxidizing or bleaching agents), enzymes, ether sulfate surfactants, ethylene oxide sulfate surfactants, and propylene oxide sulfate surfactants. In an embodiment, the treatment composition may be free of one or more of cationic surfactants, quaternary amine antimicrobial components, and solvents.

Another aspect of the present disclosure relates to a method of treating a fabric including contacting the fabric (e.g., soiled or otherwise stained) with any of the treatment compositions described herein. The terms "soil" and "stain" are used interchangeably herein. In an embodiment, the contacting occurs before washing the fabric (i.e., the treatment composition is applied as a pre-treatment to later contemplated washing). In another embodiment, the contacting occurs at the time the fabric is washed (e.g., by adding the treatment composition to the wash water), so that the treatment composition is used to boost stain removal performance.

Further features and advantages of the present invention will become apparent to those of ordinary skill in the art in view of the detailed description of preferred embodiments below.

DETAILED DESCRIPTION OF THE PREFERRED EMBODIMENTS

I. Definitions

Before describing the present invention in detail, it is to be understood that this invention is not limited to particularly exemplified compositions, systems or process parameters that may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

The term "comprising" which is synonymous with "including," "containing," or "characterized by," is inclusive or open-ended and does not exclude additional, unrecited elements or method steps.

The term "consisting essentially of" limits the scope of a claim to the specified materials or steps "and those that do not materially affect the basic and novel characteristic(s)" of the claimed invention.

The term "consisting of" as used herein, excludes any element, step, or ingredient not specified in the claim.

It must be noted that, as used in this specification and the appended claims, the singular forms "a," "an" and "the" include plural referents unless the content clearly dictates otherwise. Thus, for example, reference to a "surfactant" includes one, two or more surfactants.

Numbers, percentages, ratios, or other values stated herein may include that value, and also other values that are about or approximately the stated value, as would be appreciated by one of ordinary skill in the art. A stated value should therefore be interpreted broadly enough to encompass values that are at least close enough to the stated value to perform a desired function or achieve a desired result, and/or values that round to the stated value. The stated values include at least the variation to be expected in a typical manufacturing or formulation process, and may include values that are within 10%, within 5%, within 1%, etc. of a stated value. Furthermore, the terms "substantially", "similarly", "about" or "approximately" as used herein represent an amount or state close to the stated amount or state that still performs a desired function or achieves a desired result. For example, the term "substantially" "about" or "approximately" may refer to an amount that is within 10% of, within 5% of, or within 1% of, a stated amount or value.

Some ranges may be disclosed herein. Additional ranges may be defined between any values disclosed herein as being exemplary of a particular parameter. All such ranges are contemplated and within the scope of the present disclosure.

In the application, effective amounts are generally those amounts listed as the ranges or levels of ingredients in the descriptions, which follow hereto. Unless otherwise stated, amounts listed in percentage ("%'s") are in weight percent (based on 100% active) of the treatment composition.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

II. Introduction

The present invention is directed to treatment compositions for use in laundry. The compositions can effectively remove stains as compared to detergent alone, both through the wash and within minutes, i.e., "right before your eyes" as a pre-treatment. The compositions advantageously are capable of removing stains without the use of oxidizing agents (e.g., hypochlorite or other hypohalites, hydrogen peroxide or other peroxides), so that the compositions are safer to use on a wide variety of fabrics and dyes. Using the present compositions is more convenient than existing pre-treatment spotters because the same product both boosts performance through the wash and pre-treats stains very effectively.

The composition may be free of one or more of peroxides, hypohalites, enzymes, ether sulfate surfactants such as sodium laureth sulfate with an average of 2 ethoxy groups per molecule (i.e. Standopol® ES-2 or STEOL® CS-230), and alkylene oxide sulfate surfactants, such as ethylene oxide ("EO") sulfate surfactants, and propylene oxide ("PO") sulfate surfactants, such as alkyl ether sulfate with an average 13 propoxyl units per molecule (i.e. ENORDET™ J13131). The compositions may also be free from other components, such as cationic surfactants, quaternary amine antimicrobial components and solvents (e.g., $C_1$-$C_4$ alcohols).

The compositions may include one or more alkoxylate surfactants in an amount of up to about 10% by weight, and a polymeric anti-redeposition agent selected from the group consisting of an ethoxylated polyethyleneimine polymer, and an acrylate copolymer (e.g., an acrylate-maleate copolymer), and combinations thereof.

One or more various other optional components may be included, such as a thickener, an optical brightening agent, a pH adjusting agent, a co-surfactant, a hydrotrope, a fragrance, a dye, a pigment, a stain and soil repellant, a lubricant, a solubilizing agent, a suspension agent, a stabilizer, a defoamer, a preservative, a lubricant, a complexing agent, a chelating agent, or combinations thereof.

Even where one or more optional components are included, typically the concentration of ingredients other than water is quite low, such that the water may comprise at least 50%, at least 60%, at least 70%, at least 75%, at least 80%, at least 85%, at least 90%, at least 91%, at least 92%, or at least 93% by weight of the composition.

III. Exemplary Treatment Compositions

A. Alkoxylate Surfactants

The compositions may include one or more alkoxylate surfactants, which serve as a surfactant and as a soil remover. In an embodiment, the alkoxylate surfactant may be nonionic. In one embodiment, the alkoxylate surfactant may be branched. Examples of suitable alkoxylate surfactants include branched, nonionic alkyl polyethylene glycol ethers made from Guerbet alcohols and ethylene oxide. It will be apparent that alkylene oxides other than ethylene oxide could be used. For example, branched nonionic alkyl polyethylene/polypropylene glycol ethers may also be suitable for use, e.g., made from Guerbet alcohols and ethylene oxide and propylene oxide. As will be appreciated by those of skill in the art, Guerbet alcohols may have the structure shown below:

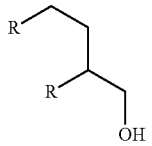

Where R is an alkyl group (e.g., as derived from a primary aliphatic alcohol in a Guerbet reaction). In an embodiment, each R may independently represent an alkyl group having from 3 to 22, from 6 to 18, from 6 to 16, from 6 to 14, or from 8 to 12 carbons (e.g., $C_3$, $C_4$, $C_6$, $C_8$, $C_{10}$, $C_{12}$, $C_{14}$, $C_{16}$, $C_{18}$, $C_{20}$, or any range defined between two of any such alkyl groups). In an embodiment, both R groups may be identical, although in other embodiments they may differ from one another.

Exemplary branched nonionic alkyl polyethylene glycol ethers (e.g., made from a $C_{10}$ Guerbet alcohol and 2 alkylene oxides, namely ethylene oxide and propylene oxide) include the LUTENSOL® XL series of surfactants, such as LUTENSOL® XL 40, LUTENSOL® XL 50, LUTENSOL® XL 60, LUTENSOL® XL 70, LUTENSOL® XL 79, LUTENSOL® XL 80, LUTENSOL® XL 89, LUTENSOL® XL 90, LUTENSOL® XL 99, LUTENSOL® XL 100, and LUTENSOL® XL 140, available from BASF® Corporation (Florham Park N.J.). The LUTENSOL® XP series of surfactants available from BASF® Corporation may also be suitable for use. A combination of different branched nonionic alkyl polyethylene glycol ethers may be used.

In addition to, or alternative to the branched nonionic alkyl polyethylene glycol ethers, some linear nonionic alcohol ethoxylate or other alkoxylate surfactants may be suitable for use as the alkoxylate surfactant. Examples of such include the SURFONIC® L series of surfactants, particularly the SURFONIC® L12 series of surfactants (e.g., lauryl alcohol ethoxylates). An example of such is SURFONIC® L12-8, available from HUNTSMAN® Corporation (Woodlands, Tex.). Other examples of alkoxylate surfactants include the PLURAFAC® series of surfactants, such as PLURAFAC® SL-62, available from BASF® Corporation. Alcohol ethoxylate surfactants may be made by reaction of a primary or secondary alcohol (e.g., $C_4$ to $C_{22}$, $C_6$ to $C_{18}$, $C_8$ to $C_{16}$) with ethylene oxide ($C_2H_4O$). Often the number of moles of ethoxylation is proprietary to the surfactant manufacturer, although this degree of ethoxylation is often from about 4 moles to about 12 moles, or from about 6 moles to about 10 moles. Other alcohol ethoxylate surfactants that may be suitable for use are available from STEPAN®, DOW®, and others.

By way of example, LUTENSOL® XL 70, LUTENSOL® XL 80, LUTENSOL® XL 90, and SURFONIC® L12-8 have moles of ethoxylation values of 7, 8, 9, and 8, respectively. Higher moles of ethoxylation may aid in raising the cloud point of the composition, so as to increase shelf stability (e.g., particularly under elevated temperature storage conditions). Addition of an anionic surfactant (e.g., an alkyl sulfate) may also aid in increasing such stability.

The alkoxylate surfactant may have a hydrophilic-lipophilic balance ("HLB") value from 11 to 14. For example, LUTENSOL® XL 70, LUTENSOL® XL 80, LUTENSOL® XL 90, and PLURAFAC® SL-62 have HLB values of 12, 13, 14, and 14, respectively. Where a blend of a plurality of alkoxylate surfactants is used, one of the alkoxylate surfactants may have more moles of ethoxylation and/or a higher HLB value than another of the included alkoxylate surfactants (e.g., a blend of LUTENSOL® XL 70 and LUTENSOL® XL 90).

Where a blend of multiple alkoxylate surfactants is included, the alkoxylate surfactant having a lower HLB value and/or lower moles of ethoxylation may dominate. For example, a weight ratio of the alkoxylate surfactant having lower HLB and/or lower moles of ethoxylation may be from 1.5:1 to 4:1, from 2:1 to 3.5:1, or from 2.5:1 to 3:1. In another embodiment, the blend may be formulated with substantially equal weight percentages of each of the alkoxylate surfactants, or even with more of the alkoxylate surfactant with the higher HLB and/or higher moles of ethoxylation. The blend of alkoxylate surfactants may have an average HLB value of between 11 and 14, as calculated by an average of the HLB values of the alkoxylate surfactants weighted by the weight fraction of each alkoxylate surfactant in the composition.

The cumulative amount of the one or more alkoxylate surfactants (i.e., the sum total weight percent of any alkoxylate surfactants included) may be up to about 20%, up to about 15%, up to about 10%, from about 3% to about 10%, from about 3% to about 9%, from about 4% to about 8%, or from about 5% to about 8% by weight of the composition. For example, the weight percent of the alkoxylate surfactants may be about 3%, about 4%, about 5%, about 6%, about 7%, about 8%, about 9%, or about 10% by weight of the composition, or any range defined between two of such weight percent values.

Disclosure of various other suitable surfactants may be found in one or more of U.S. Pat. No. 3,929,678 to Laughlin, U.S. Pat. No. 4,259,217 to Murphy, U.S. Pat. No. 5,776,872 to Giret et al., U.S. Pat. No. 5,883,059 to Furman et al., U.S. Pat. No. 5,883,062 to Addison et al., U.S. Pat. No. 5,906,973 to Ouzounis et al., and U.S. Pat. No. 4,565,647 to Llenado. Each of the above patents is incorporated by reference.

B. Polymeric Anti-Redeposition Agents

The treatment compositions may advantageously include a polymeric anti-redeposition agent to prevent soils and stains loosened from the fabric (e.g., by the alkoxylate surfactant) from redepositing on the fabric. In an embodiment, the anti-redeposition agent is a polymer, such as an ethoxylated polyethyleneimine polymer, and/or an acrylate copolymer. Exemplary ethyoxylated polyethyleneimine polymers may be derived from ethylene imine.

In an embodiment, the polymer may be a homopolymer. The molecular weight of the polymer may be about 5,000 Daltons to about 500,000 Daltons, from about 10,000 Daltons to about 250,000 Daltons, from about 20,000 Daltons to about 100,000 Daltons, or from about 50,000 Daltons to 100,000 Daltons. Examples of suitable ethoxylated polyethyleneimine polymers including aziridine groups include the SOKALAN® HP series of polymers, such as SOKALAN® HP 20, available from BASF® Corporation.

Copolymers of acrylic acid may also be suitable for use as the anti-redeposition agent. Copolymers of acrylic acid and another carboxylic acid (e.g., maleic acid, or another carboxylic acid) may be suitable. The SOKALAN® CP series of polymers (e.g., SOKALAN® CP 5), available from BASF® Corporation, are examples of such. The copolymer may be a random copolymer, an alternating copolymer, or a block copolymer. The molecular weight of the copolymer may be about 5,000 Daltons to about 500,000 Daltons, from about 10,000 Daltons to about 250,000 Daltons, from about 20,000 Daltons to 100,000 Daltons, or from about 50,000 Daltons to about 100,000 Daltons. For example, SOKALAN® CP 5 is a maleic acid-acrylic acid copolymer having a molecular weight of about 70,000 Daltons (e.g., average MW).

The polymeric anti-redeposition agent may be included up to about 5%, from about 0.05% to about 5%, from about 0.1% to about 5%, from about 0.1% to about 3%, from about 0.2% to about 3%, from about 0.3% to about 2% or from about 0.5% to about 2% by weight of the composition. For example, the weight percent of the polymeric anti-redeposition agent may be about 0.05%, about 0.1%, about 0.2%, about 0.3%, about 0.4%, about 0.5%, about 1%, about 1.25%, about 1.5%, about 2%, about 2.5%, about 3%, about 3.5%, about 4%, about 4.5%, or about 5% by weight of the composition, or any range defined between two of such weight percent values.

The weight ratio of the alkoxylate surfactant to the polymeric anti-redeposition agent may be at least 1:1, at least 2:1, or at least 3:1, from about 1:1 to about 50:1, from about 2:1 to about 50:1, from about 2:1 to about 30:1, from about 3:1 to about 20:1, from about 3:1 to about 15:1, from about 3:1 to about 10:1. For example, the weight ratio of the alkoxylate surfactant to the polymeric anti-redeposition agent may be about 1:1, about 2:1, about 3:1, about 4:1, about 5:1, about 6:1, about 7:1, about 8:1, about 9:1, about 10:1, about 11:1, about 12:1, about 13:1, about 14:1, about 15:1, about 16:1, about 17:1, about 18:1, about 19:1 about 20:1, any other value between the above ranges, or within any range defined between any two of the foregoing values.

While mentioned that some embodiments of the present composition may be free of cationic surfactants, it will be appreciated by those of skill in the art that the polymeric anti-redeposition agent may be a cationic polymer, although this component is not added as a cationic surfactant, but for another purpose. In embodiments free of cationic surfactants, it is meant that no cationic non-polymeric surfactants are included, or in other words, that no components included for surfactant purposes are cationic.

C. Thickeners and Co-Surfactants

The treatment composition may include a thickener to increase the viscosity of the composition. Such altered rheology may aid the composition in remaining on a location of a fabric were sprayed, dispensed, or otherwise placed when used as a pre-treatment. For example, a "runny", or "thin" treatment composition may have difficulty remaining in place, in contact with the stain being treated, particularly when used as a pre-treatment, where treatment occurs outside of the typical diluting wash water. Examples of thickeners include, but are not limited to hydroxyethyl cellulose, hydroxypropyl cellulose, xanthan gum, gum arabic, gum ghatti, gum tragacanth, karaya gum, guar gum, locust bean gum, beta-glucan, chicle gum, dammar gum, glucomannan, mastic gum, psyllium gum, spruce gum, tara gum, gellan gum, carrageenan, and combinations thereof. Hydroxyethyl cellulose and hydroxypropyl cellulose are examples of cellulosic thickeners, while the other thickeners listed above may be characterized as polysaccharide gums. When using a cellulosic thickener such as hydroxyethyl cellulose and/or hydroxypropyl cellulose, a co-surfactant and/or hydrotrope (e.g., the addition of anionic surfactant such as sodium lauryl sulfate) may be helpful to improve phase stability, particularly to improve shelf-stability when the treatment composition may be stored at elevated temperatures (e.g., up to about 50° C.).

Where such a co-surfactant is added, it may be included in relatively small amounts, e.g., up to about 2%, up to about 1.5%, up to about 1%, up to about 0.75%, up to about 0.5%, from about 0.01% to about 1%, from about 0.1% to about 1%, from about 0.15% to about 0.75%, from about 0.2% to about 0.5%, or from about 0.2% to about 0.3%. For example, such a co-surfactant (e.g., sodium lauryl sulfate, or another alkyl sulfate) may be included in an amount of about 0.01%, about 0.05%, about 0.1%, about 0.15%, about 0.2%, about 0.25%, about 0.3%, about 0.35%, about 0.4%, about 0.45%, about 0.5%, about 0.55%, about 0.6%, about 0.65%, about 0.7%, about 0.75%, about 0.8%, about 0.85%, about 0.9%, about 0.95%, about 1%, or within any range defined between two of any of the values mentioned above. In an embodiment as described herein, such an included co-surfactant may be anionic (e.g., an alkyl sulfate).

The amount of the thickener, where included, may be up to about 2%, up to about 1.5%, up to about 1%, up to about 0.75%, up to about 0.5%, from about 0.01% to about 1%, from about 0.1% to about 1%, from about 0.15% to about 0.75%, from about 0.15% to about 0.5%, or from about 0.2% to about 0.3%. For example, the thickener may be included in an amount of about 0.1%, about 0.15%, about 0.2%, about 0.25%, about 0.3%, about 0.35%, about 0.4%, about 0.45%, about 0.5%, about 0.55%, about 0.6%, about 0.65%, about 0.7%, about 0.75%, about 0.8%, about 0.85%, about 0.9%, about 0.95%, about 1%, or within any range defined between two of any of the values mentioned above. The polysaccharide gum thickeners (e.g., xanthan gum) may be included in relatively lower amounts as compared to when thickening the composition with a cellulosic thicker, such as hydroxyethyl cellulose, to achieve a desired viscosity, as will be apparent from the Examples which follow.

The thickener may be included in an amount such that the treatment compositions may be of moderate viscosity. In an embodiment, the viscosity may be more than about 100 centipoise, more than about 1,000 centipoise, from about 100 centipoise to about 100,000 centipoise, from about 100 centipoise to about 50,000 centipoise, from about 100 centipoise to about 5000 centipoise, or from about 100 centipoise to about 2,000 centipoise, or from about 500 centipoise to about 1500 centipoise.

D. pH Adjusting Agents

The present treatment compositions may include one or more pH adjusting agents. In an embodiment, the pH adjusting agent may be an organic acid. Where an organic acid is included, its inclusion is for adjusting pH, rather than for another purpose (e.g., sanitization). The compositions may have a pH within a range from about 3 to about 10, from about 4 to about 9, from about 4 to about 7, at least 3, at least 4, not more than 10, not more than 9, or not more than 8. For example, pH may be about 3, about 4, about 5, about 6, about 7, about 8, about 9, or about 10, or any values therein between, or within any ranges defined between any two of such pH values.

Any of various organic and inorganic acids may be suitable for use. The most common organic acids include but are not limited to, carboxylic acids, sulfonic acids, and combinations thereof. Organic acids are typically weak acids that usually do not completely dissociate in water. Common inorganic acids include but are not limited to phosphoric acid and sulfuric acid. All of these acids may be used as pH adjusting agents.

Exemplary sulfonic acids may include sulfonic acids having the general structure:

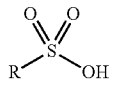

Where the R group may represent any alkyl or aryl group. Numerous examples will be apparent to those of skill in the art. Non-limiting examples may include methane sulfonic acid, benzene sulfonic acid, alkyl benzene sulfonic acids, and combinations thereof. Numerous carboxylic acids may also be suitable for use, including tartaric acid, citric acid, malic acid, mandelic acid, oxalic acid, glycolic acid, lactic acid, acetic acid, and combinations thereof. Sulfonic acids corresponding to any of the above carboxylic acids may also be used (e.g., where the carboxylic acid group is replaced with a sulfonic acid group). Sulfonic acids typically exhibit higher pKa values, (i.e., they are stronger acids) than the corresponding carboxylic acid, and so may be selected for this reason in at least some embodiments. Because the compositions include such acids for pH adjustment (rather than sanitization or other purposes), the concentration of any included pH adjusting agent may be less than 5%, less than 4%, less than 3%, less than 2%, less than 1%, less than 0.5%, less than 0.2%, or less than 0.1% by weight, or from 0.001% to 1%, from 0.005% to 1%, from 0.01% to 0.5%, or from 0.02% to 0.1% by weight. For example, the pH adjusting agent may be included in an amount of about 0.01%, about 0.02%, about 0.03%, about 0.04%, about 0.05%, about 0.06%, about 0.07%, about 0.08%, about 0.09%, about 0.1%, about 0.15%, about 0.2%, about 0.25%, about 0.3%, about 0.35%, about 0.4%, about 0.45%, about 0.5%, about 0.55%, about 0.6%, about 0.65%, about 0.7%, about 0.75%, about 0.8%, about 0.85%, about 0.9%, about 0.95%, about 1%, about 1.2%, about 1.4%, about 1.6%, about 1.8%, about 2%, about 2.5%, or about 3%, or within any range defined between two of any of the values mentioned above. Because of the greater strength of sulfonic acids, they may be included in relatively lower amounts as compared to carboxylic acids in order to reach a desired pH.

E. Other Components

As will be apparent from the examples in the Examples section which follows, the treatment compositions may optionally include an optical brightening agent, a hydrotrope, a fragrance, a dye, a pigment, a stain and soil repellant, a lubricant, a solubilizing agent, a suspension agent, a stabilizer, a defoamer, a preservative, a lubricant, a complexing agent, a chelating agent, and combinations thereof. Any such components may typically individually comprise no more than 3%, no more than 2%, no more than 1%, or no more than 0.5% of the composition by weight.

While the compositions may be free from oxidizing agents, such as hydrogen peroxide, other peroxides, hypochlorite, or other hypohalites, it will be appreciated that the compositions may be compatible for use with compositions including such oxidizing agents. For example, in some embodiments, a consumer may use the treatment composition as a pre-treatment or added to the wash water, and may also add a composition including an oxidizing agent to the wash water as well. In other embodiments, an oxidizing agent could be included in the treatment composition, although its absence is helpful in ensuring that the treatment compositions exhibit a very high compatibility across a wide variety of fabrics, of any color, dyed with any dye.

IV. EXAMPLES

Example 1

An exemplary aqueous treatment composition was prepared by combining the components as shown in Table 1 below. The composition of Example 1 had a pH of 5.

TABLE 1

| Component | Wt. % Active | Purpose |
|---|---|---|
| water | 90.4 | carrier |
| hydroxyethyl cellulose | 0.75 | thickener |
| alkoxylate surfactant (LUTENSOL ® XL 80) | 7.46 | surfactant/soil removal |
| ethoxylated polyethylene imine (SOKALAN ® HP 20) | 0.78 | anti-redeposition/soil removal |
| Disodium distyrylbiphenyl disulfonate | 0.09 | optical brightener |
| methanesulfonic acid | 0.07 | pH adjustment |
| sodium alkyl sulfate | 0.25 | phase stabilizer/soil removal/co-surfactant |
| Fragrance | 0.2 | Scent |

Example 2

An exemplary aqueous treatment composition was prepared by combining the components as shown in Table 2 below. The composition of Example 2 had a pH of 8.5.

TABLE 2

| Component | Wt. % Active | Purpose |
|---|---|---|
| water | 92.52 | carrier |
| xanthan gum | 0.2 | thickener |
| alkoxylate surfactant (LUTENSOL ® XL 90) | 1.28 | surfactant/soil removal |
| alkoxylate surfactant (LUTENSOL ® XL 70) | 4.04 | surfactant/soil removal |
| acrylic acid and maleic acid copolymer (SOKALAN ® CP 5) | 1.7 | anti-redeposition/soil removal |
| Disodium distyrylbiphenyl disulfonate | 0.06 | optical brightener |
| Fragrance | 0.2 | Scent |

Example 3

An exemplary aqueous treatment composition was prepared by combining the components as shown in Table 3 below. The composition of Example 3 had a pH of 4.

TABLE 3

| Component | Wt. % Active | Purpose |
|---|---|---|
| water | 91.01 | carrier |
| xanthan gum | 0.2 | thickener |
| alkoxylate surfactant (LUTENSOL ® XL 90) | 1.28 | surfactant/soil removal |
| alkoxylate surfactant (LUTENSOL ® XL 70) | 4.04 | surfactant/soil removal |
| acrylic acid and maleic acid copolymer (SOKALAN ® CP 5) | 1.7 | anti-redeposition/soil removal |
| Disodium distyrylbiphenyl disulfonate | 0.06 | optical brightener |
| methanesulfonic acid | 1.51 | pH adjustment |
| Fragrance | 0.2 | Scent |

Example 4

An exemplary aqueous treatment composition was prepared by combining the components as shown in Table 4 below. The composition of Example 4 had a pH of 6.

TABLE 4

| Component | Wt. % Active | Purpose |
|---|---|---|
| water | 92.98 | carrier |
| xanthan gum | 0.2 | thickener |
| alkoxylate surfactant (LUTENSOL ® XL 90) | 1.11 | surfactant/soil removal |
| alkoxylate surfactant (LUTENSOL ® XL 70) | 3.51 | surfactant/soil removal |
| acrylic acid and maleic acid copolymer (SOKALAN ® CP 5) | 1.48 | anti-redeposition/soil removal |
| Disodium distyrylbiphenyl disulfonate | 0.06 | optical brightener |
| methanesulfonic acid | 0.5 | pH adjustment |
| Fragrance | 0.15 | Scent |

Example 5

An exemplary aqueous treatment composition was prepared by combining the components as shown in Table 5 below. The composition of Example 5 had a pH of 6.

TABLE 5

| Component | Wt. % Active | Purpose |
|---|---|---|
| water | 93.24 | carrier |
| xanthan gum | 0.2 | thickener |
| alkoxylate surfactant (LUTENSOL ® XL 90) | 1.28 | surfactant/soil removal |
| alkoxylate surfactant (LUTENSOL ® XL 70) | 4.04 | surfactant/soil removal |
| ethoxylated polyethylene imine (SOKALAN ® HP 20) | 1.0 | anti-redeposition/soil removal |
| Disodium distyrylbiphenyl disulfonate | 0.06 | optical brightener |
| methanesulfonic acid | 0.03 | pH adjustment |
| Fragrance | 0.15 | Scent |

Example 6

An exemplary aqueous treatment composition was prepared by combining the components as shown in Table 6 below. The composition of Example 6 had a pH of 8.5.

TABLE 6

| Component | Wt. % Active | Purpose |
|---|---|---|
| water | 92.57 | carrier |
| xanthan gum | 0.2 | thickener |
| alcohol ethoxylate surfactant (SURFONIC ® L12-8) | 5.32 | surfactant/soil removal |
| acrylic acid and maleic acid copolymer (SOKALAN ® CP 5) | 1.7 | anti-redeposition/soil removal |
| Disodium distyrylbiphenyl disulfonate | 0.06 | optical brightener |
| Fragrance | 0.15 | Scent |

Example 7

An exemplary aqueous treatment composition was prepared by combining the components as shown in Table 7 below. The composition of Example 7 had a pH of 4.

TABLE 7

| Component | Wt. % Active | Purpose |
|---|---|---|
| water | 92.22 | carrier |
| xanthan gum | 0.2 | thickener |
| alcohol ethoxylate surfactant (PLURAFAC ® SL-62) | 6.25 | surfactant/soil removal |
| ethoxylated polyethylene imine (SOKALAN ® HP 20) | 0.8 | anti-redeposition/soil removal |
| Disodium distyrylbiphenyl disulfonate | 0.06 | optical brightener |
| sodium alkyl sulfate | 0.25 | phase stabilizer/soil removal/co-surfactant |
| methanesulfonic acid | 0.07 | pH adjustment |
| Fragrance | 0.15 | Scent |

Example 8

An exemplary aqueous treatment composition was prepared by combining the components as shown in Table 8 below. The composition of Example 8 had a pH of 4.

TABLE 8

| Component | Wt. % Active | Purpose |
|---|---|---|
| water | 93.73 | carrier |
| xanthan gum | 0.2 | thickener |
| alkoxylate surfactant (LUTENSOL ® XL 70) | 2.5 | surfactant/soil removal |
| alkoxylate surfactant (LUTENSOL ® XL 80) | 2.5 | surfactant/soil removal |
| ethoxylated polyethylene imine (SOKALAN ® HP 20) | 0.52 | anti-redeposition/soil removal |
| Disodium distyrylbiphenyl disulfonate | 0.06 | optical brightener |
| sodium alkyl sulfate | 0.29 | phase stabilizer/soil removal/co-surfactant |
| methanesulfonic acid | 0.05 | pH adjustment |
| Fragrance | 0.15 | Scent |

Example 9

An exemplary aqueous treatment composition was prepared by combining the components as shown in Table 9 below. The composition of Example 9 had a pH of 6.

TABLE 9

| Component | Wt. % Active | Purpose |
|---|---|---|
| water | 92.93 | carrier |
| xanthan gum | 0.2 | thickener |
| alkoxylate surfactant (LUTENSOL ® XL 70) | 5.75 | surfactant/soil removal |
| ethoxylated polyethylene imine (SOKALAN ® HP 20) | 0.32 | anti-redeposition/soil removal |
| Disodium distyrylbiphenyl disulfonate | 0.06 | optical brightener |
| sodium alkyl sulfate | 0.52 | phase stabilizer/soil removal/co-surfactant |
| methanesulfonic acid | 0.07 | pH adjustment |
| Fragrance | 0.15 | Scent |

Example 10

An exemplary aqueous treatment composition was prepared by combining the components as shown in Table 10 below. The composition of Example 10 had a pH of 4.

TABLE 10

| Component | Wt. % Active | Purpose |
|---|---|---|
| water | 93.73 | carrier |
| xanthan gum | 0.2 | thickener |
| alkoxylate surfactant (LUTENSOL ® XL 80) | 5.0 | surfactant/soil removal |
| ethoxylated polyethylene imine (SOKALAN ® HP 20) | 0.52 | anti-redeposition/soil removal |
| Disodium distyrylbiphenyl disulfonate | 0.06 | optical brightener |
| sodium alkyl sulfate | 0.29 | phase stabilizer/soil removal/co-surfactant |
| methanesulfonic acid | 0.05 | pH adjustment |
| Fragrance | 0.15 | Scent |

Example 11

An exemplary aqueous treatment composition was prepared by combining the components as shown in Table 11 below. The composition of Example 11 had a pH of 5.

TABLE 11

| Component | Wt. % Active | Purpose |
|---|---|---|
| water | 93.74 | carrier |
| xanthan gum | 0.2 | thickener |
| alkoxylate surfactant (LUTENSOL ® XL 80) | 5.0 | surfactant/soil removal |
| ethoxylated polyethylene imine (SOKALAN ® HP 20) | 0.52 | anti-redeposition/soil removal |
| Disodium distyrylbiphenyl disulfonate | 0.06 | optical brightener |
| sodium alkyl sulfate | 0.29 | phase stabilizer/soil removal/co-surfactant |
| methanesulfonic acid | 0.04 | pH adjustment |
| Fragrance | 0.15 | Scent |

Example 12

An exemplary aqueous treatment composition was prepared by combining the components as shown in Table 12 below. The composition of Example 12 had a pH of 4.

TABLE 12

| Component | Wt. % Active | Purpose |
|---|---|---|
| water | 93.17 | carrier |
| xanthan gum | 0.2 | thickener |
| alkoxylate surfactant (LUTENSOL ® XL 80) | 5.85 | surfactant/soil removal |
| ethoxylated polyethylene imine (SOKALAN ® HP 20) | 0.52 | anti-redeposition/soil removal |
| Disodium distyrylbiphenyl disulfonate | 0.06 | optical brightener |
| methanesulfonic acid | 0.05 | pH adjustment |
| Fragrance | 0.15 | Scent |

Example 13

An exemplary aqueous treatment composition was prepared by combining the components as shown in Table 13 below. The composition of Example 13 had a pH of 5.

TABLE 13

| Component | Wt. % Active | Purpose |
|---|---|---|
| water | 93.19 | carrier |
| xanthan gum | 0.2 | thickener |
| alkoxylate surfactant (LUTENSOL ® XL 80) | 5.85 | surfactant/soil removal |
| ethoxylated polyethylene imine (SOKALAN ® HP 20) | 0.52 | anti-redeposition/soil removal |
| Disodium distyrylbiphenyl disulfonate | 0.06 | optical brightener |
| methanesulfonic acid | 0.03 | pH adjustment |
| Fragrance | 0.15 | Scent |

Example 14

An exemplary aqueous treatment composition was prepared by combining the components as shown in Table 14 below. The composition of Example 14 had a pH of 4.

TABLE 14

| Component | Wt. % Active | Purpose |
|---|---|---|
| water | 93.66 | carrier |
| hydroxyethyl cellulose | 0.56 | thickener |
| alkoxylate surfactant (LUTENSOL ® XL 80) | 5.0 | surfactant/soil removal |
| ethoxylated polyethylene imine (SOKALAN ® HP 20) | 0.52 | anti-redeposition/soil removal |
| Disodium distyrylbiphenyl disulfonate | 0.19 | optical brightener |
| methanesulfonic acid | 0.07 | pH adjustment |
| Fragrance | 0.15 | Scent |

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

The invention claimed is:

1. A treatment composition comprising:

(a) an alkoxylate surfactant;

(b) a polymeric anti-redeposition agent selected from the group consisting of an ethoxylated polyethyleneimine polymer, an acrylate copolymer, and combinations thereof;

(c) water;

(d) wherein the pH of the composition is at least 4 to about 10; and (e) wherein the composition is free of oxidizing agents, enzymes, ether sulfate surfactants, ethylene oxide sulfate surfactants, and propylene oxide sulfate surfactants.

2. The composition of claim 1, wherein the acrylate copolymer comprises an acrylate/maleate copolymer.

3. The composition of claim 1, wherein the composition further comprises a thickener selected from the group consisting of cellulosic thickeners and polysaccharide gums.

4. The composition of claim 3, wherein the thickener is selected from the group consisting of hydroxyethyl cellulose, hydroxypropyl cellulose, xanthan gum, gum arabic, gum ghatti, gum tragacanth, karaya gum, guar gum, locust bean gum, beta-glucan, chicle gum, dammar gum, glucomannan, mastic gum, psyllium gum, spruce gum, tara gum, gellan gum, carrageenan, and combinations thereof.

5. The composition of claim 1, wherein the composition further comprises a thickener selected from the group consisting of hydroxyethyl cellulose, xanthan gum and combinations thereof.

6. The composition of claim 5, wherein the composition further comprises at least one of a hydrotrope or a co-surfactant to improve phase stability of the composition.

7. The composition of claim 1, further comprising an anionic co-surfactant in at amount up to about 1% by weight of the composition.

8. The composition of claim 1, wherein the alkoxylate surfactant is included in an amount of up to about 10% by weight of the composition.

9. The composition of claim 1, wherein the polymeric anti-redeposition agent is included in an amount of up to about 2% by weight of the composition.

10. The composition of claim 1, wherein the composition further comprises 0.03% to 1.51% of an acid.

11. The composition of claim 1, wherein the alkoxylate surfactant is a branched nonionic surfactant derived from a Guerbet alcohol and alkylene oxide.

12. The composition of claim 1, further comprising an optical brightener.

13. A treatment composition comprising:

(a) an alkoxylate surfactant included in an amount of up to about 10% by weight of the composition;

(b) a polymeric anti-redeposition agent selected from the group consisting of an ethoxylated polyethyleneimine polymer, an acrylate copolymer, and combinations thereof;

(c) water;

(d) 0.03% to 1.51% of an acid; and (e) wherein the composition is free of peroxides, hypohalites, enzymes, ether sulfate surfactants, ethylene oxide sulfate surfactants, and propylene oxide sulfate surfactants.

14. The composition of claim 13, wherein the composition has a pH from about 4 to about 7.

15. The composition of claim 13, wherein the composition further comprises a thickener selected from the group consisting of cellulosic thickeners and polysaccharide gums.

16. A treatment composition comprising:

(a) an alkoxylate surfactant;

(b) a polymeric anti-redeposition agent selected from the group consisting of an ethoxylated polyethyleneimine polymer, an acrylate copolymer, and combinations thereof;

(c) water; and (d) an optical brightener;

(e) wherein the composition is free of peroxides, hypohalites, enzymes, ether sulfate surfactants, ethylene oxide sulfate surfactants, and propylene oxide sulfate surfactants.

17. The composition of claim 16, wherein the composition has a pH from about 3 to about 10.

18. The composition of claim 16, wherein the composition further comprises 0.03% to 1.51% of an acid.

19. The composition of claim 16, wherein the composition further comprises a thickener selected from the group consisting of cellulosic thickeners and polysaccharide gums.

20. The composition of claim 13, wherein the composition further comprises an optical brightener.

* * * * *